US007325627B2

(12) United States Patent
Tanji

(10) Patent No.: US 7,325,627 B2
(45) Date of Patent: Feb. 5, 2008

(54) AIR TOOL

(75) Inventor: Isamu Tanji, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 49 days.

(21) Appl. No.: 11/441,073

(22) Filed: May 26, 2006

(65) Prior Publication Data

US 2006/0278416 A1 Dec. 14, 2006

(30) Foreign Application Priority Data

May 30, 2005 (JP) ..... P2005-156694

(51) Int. Cl.
*B25D 15/00* (2006.01)

(52) U.S. Cl. ..... 173/169; 173/93.5; 173/168

(58) Field of Classification Search ..... 173/93, 173/93.5, 104, 109, 170, 168, 169
See application file for complete search history.

(56) References Cited

U.S. PATENT DOCUMENTS 4,024,892 A * 5/1977 Prisco et al. ..... 137/630.14
4,776,561 A * 10/1988 Braunlich et al. ..... 251/39
5,377,769 A * 1/1995 Hasuo et al. ..... 173/169
5,775,439 A * 7/1998 Biek ..... 173/1
5,797,462 A * 8/1998 Rahm ..... 173/169
5,918,686 A * 7/1999 Izumisawa ..... 173/20
6,062,323 A * 5/2000 Pusateri et al. ..... 173/169
6,161,628 A * 12/2000 Liu ..... 173/168
6,164,387 A * 12/2000 Chang ..... 173/169
6,196,331 B1 * 3/2001 Naito et al. ..... 173/169
6,708,779 B2 * 3/2004 Taga ..... 173/104
6,880,645 B2 * 4/2005 Izumisawa ..... 173/93.5
6,902,011 B2 * 6/2005 Hall ..... 173/169

FOREIGN PATENT DOCUMENTS

JP 2003-161302 6/2003
JP 2004-230533 8/2004

* cited by examiner

*Primary Examiner*—Scott A. Smith
(74) *Attorney, Agent, or Firm*—Mattingly, Stanger, Malur & Brundidge, P.C.

(57) ABSTRACT

A center portion of a handle housing portion 3 is arranged with a pressure reducing valve mechanism portion 50 for reducing a pressure of high pressure compressed air to be surrounded by an exhaust chamber 40, in a state of making a trigger 37 ON, air pressure P22 of a secondary pressure side port 52 of the pressure reducing valve mechanism portion 50 is made to be higher than air pressure P21 of a secondary pressure side port 52 of the pressure reducing valve mechanism portion 50 in a state of making the trigger 37 OFF by communicating a hermetically closed chamber 59*a* of a pressure control spring 56 and the exhaust chamber 40 by way of a relief hole 59*b* such that an exhaust air pressure of an air motor mechanism portion 10 is added to a spring force F of the pressure control spring 56 of the pressure reducing valve mechanism portion 50.

7 Claims, 6 Drawing Sheets

AIR TOOL

CROSS-REFERENCE TO RELATED APPLICATIONS

This application is based on and claims the benefit of priority from the prior Japanese Patent Application No. 2005-156694, filed on May 30, 2005; the entire contents of which are incorporated herein by reference.

BACKGROUND OF THE INVENTION

1. Field of Invention

The present invention relates to an air tool of an air impact driver, an air impact wrench or a power source of a motor driven by compressed air, particularly relates to an air tool which can be connected to a high pressure air compressing apparatus supplying high pressure air.

2. Description of Related Art

Generally, according to an air tool of a nailing machine, an air impact driver, an air duster or the like, two kinds of a low pressure specification constituting a range of use by compressed air in a normal pressure (low pressure) region having an upper limit pressure up to 0.98 MPa and a high pressure specification constituting a range of use by compressed air in a high pressure region of 1 through 2.48 MPa with object of promotion of a function or small-sized and light-weighted formation of an air tool have been reduced into practice. Particularly, a tool of a high pressure specification is fabricated by a structure of capable of ensuring to withstand high pressure air in comparison with a tool of a low pressure specification from a view point of breakage and safety of an apparatus. There is a case in which the two kinds of air tools having different specifications of compressed air are simultaneously used at an operation site of the same construction site or the like.

Therefore, one piece of a high pressure air compressing machine (high pressure air compressor) constituting a drive source of the air tools is generally provided with two pieces of take out ports for taking out compressed air of the high pressure specification and compressed air of the low pressure specification independently from each other by aiming at a reduction in installation cost and promotion of a way of use. However, in this case, when an interchangeability is provided to modes of connecting an air hose including a socket member, a plug member and a hose member of the high pressure air take out port and the low pressure air take out port, for example, there is a concern of connecting an air tool of the low pressure specification to the high pressure air take out port, conversely, connecting an air tool of the high pressure specification to the low pressure air take out port, in the former case, there poses a problem of destructing the air hose or a seal member of the tool and in the latter case, there poses a problem that an inherent function cannot be achieved. In order to prevent the problems, air hoses without the interchangeability are respectively used by constituting the modes of connecting the air hose to the high pressure air take out port and the low pressure air take out port by respectively exclusive shapes, or constituting structures of portions of connecting the plug members or the like of the air hoses by inverse screw structures. Such a well-known technology is disclosed in, for example, JP-A-2003-161302.

On the other hand, as shown by JP-A-2004-230553, there is well known a technology of including a pressure reducing valve at a handle housing portion of the air tool of a low pressure specification and operating the air tool by reducing a pressure of high pressure air supplied from a high pressure air compressor to a pressure of compressed air at a low pressure region by the pressure reducing valve of the air tool per se. According to the technology, the above-described low pressure air take out port from the high pressure compressor is dispensed with and also the modes of connecting the air hoses can be unified to one mode exclusive for the high pressure air take out port. Thereby, a way of use of the high pressure air compressor and the connecting air hose at an operation site is promoted, also the installation cost of the air compressor can be reduced to cost of one piece of the high pressure air compressor and the above-described problems of the related art can be resolved.

SUMMARY OF INVENTION

However, according to the related art, although the pressure is reduced to that of compressed air of the low pressure specification by the pressure reducing valve provided at one end portion of the handle housing portion of the air tool, since substantially a total of the handle housing portion is used as an accumulating chamber of compressed air, in order to ensure pressure withstanding performance of the total of the handle housing, a thickness (wall thickness) of a handle member needs to be thickened. Therefore, it is difficult to achieve thin-walled formation, that is, light-weighted formation of the handle member requested for the air tool for carrying out operation while grabbing the handle housing portion.

Further, according to the air tool constituting the power source by the air motor, it is requested to accelerate a speed of rotating the air motor by promoting an efficiency of exhausting compressed air used in the air motor by widely ensuring a flow path area of an exhaust chamber communicating with an exhaust port of the air motor. However, it is difficult to ensure the wide exhaust chamber by the mode of arranging the pressure reducing valve of the air tool of the related art.

Further, according to the air tool using the air motor, it is requested to promote operability of a trigger for making ON or OFF rotation of the air motor (rotor). Particularly, according to the air tool, it is preferable to lighten a tool pull load for operating the trigger in the beginning of trigger operation and improve operability of controlling the speed of the air motor initially.

Therefore, it is an object of the invention to provide an air tool including a pressure reducing valve which can be connected to a high pressure air compressing apparatus.

It is another object of the invention to provide a structure of arranging an air tool mounted with an air motor mechanism portion, a trigger valve mechanism portion and a pressure reducing valve mechanism portion at inside of a housing.

It is still another object of the invention to provide an air tool promoting an operability of a trigger of a trigger valve mechanism portion.

According to an aspect of the invention, there is provided an air tool comprising an air motor mechanism portion having an air supply port and an exhaust port of compressed air for generating a rotational force by the compressed air, an exhaust chamber which is an exhaust chamber for discharging the compressed air exhausted from the exhaust port of the air motor mechanism portion to the atmosphere having an exhaust hole communicating with the atmosphere at a portion of the exhaust chamber, an air joint portion capable of being connected to a high pressure air supply source, a pressure reducing valve mechanism portion including a primary pressure side port (high pressure air side port)

connected to a side of the air joint portion, a secondary pressure side port (normal pressure air side port) connected to the air supply port of the air motor mechanism portion, an opening/closing valve arranged between the primary pressure side port and the secondary pressure side port for opening/closing a flow path of the compressed air flowing from the primary pressure side port to the secondary pressure side port, a pressure control spring for generating an urge force in a direction of opening the opening/closing valve, a closing direction pressure receiving face for receiving the compressed air operated in a direction of closing the opening/closing valve, and an opening direction pressure receiving face for receiving the compressed air operated to the opening/closing valve in a direction the same as the direction of the urge force of the pressure control spring, and a trigger valve mechanism portion including a valve member for opening/closing a flow path between the secondary pressure side port of the pressure reducing valve mechanism portion and the air supply port of the air motor mechanism portion, a trigger for controlling to open/close the valve member, and a pressing member for pressing in a direction reverse to a direction of operating the trigger for opening the valve member in correspondence with an amount of operating the trigger to drive the air motor mechanism portion, wherein when the air motor is driven by opening the valve member by operating the trigger of the trigger valve mechanism portion, a pressure of air exhausted from the exhaust port of the air motor mechanism portion to the exhaust chamber is added to the urge force of the pressure control spring by being received by the opening direction pressure receiving face of the pressure reducing valve mechanism portion.

According to another aspect of the invention, the air motor further comprising a body housing portion extended from one end portion to other end portion thereof along a horizontal axis line, and a handle housing portion hung from the body housing portion, wherein the air motor mechanism portion is mounted to the one end portion of the body housing portion, the pressure reducing valve mechanism portion is mounted to substantially a center portion of the handle housing portion, the exhaust chamber is mounted to the handle housing portion to surround the pressure reducing valve mechanism portion contiguously to the pressure reducing valve mechanism portion, and the trigger valve mechanism portion is mounted to a side of an upper end portion of the handle housing portion connected with the body housing.

According to still another characteristic of the invention, the air joint portion and the exhaust hole of the exhaust chamber are mounted to a side of a lower end portion of the handle housing portion.

According to still yet another aspect of the invention, the pressure control spring of the pressure reducing valve mechanism portion engages with the opening direction pressure receiving face at inside of a hermetically closed chamber of the pressure reducing valve mechanism portion, and the hermetically closed chamber is communicated with the exhaust chamber by way of a relief hole.

According to another aspect of the invention, the exhaust chamber is arranged contiguously to an outer peripheral portion of the pressure reducing valve mechanism portion.

According to the above-aspects, in an initial state (transient state) of operating the air tool by applying a trigger load, a pressure of the compressed air at the secondary pressure side port of the pressure reducing valve mechanism portion is determined in correspondence with the urge force of the pressure control spring and therefore, the trigger load necessary at an initial stage of operating the tool can be reduced, by reducing the trigger load, the load of pulling the trigger can be alleviated, further, an operability of initially controlling a speed of the air motor can be promoted. In a state of applying the trigger load after operating the air tool (ON state of trigger), by making air exhausted from the exhaust port of the air motor mechanism portion to the exhaust chamber flow into the hermetically closed chamber and receiving air by the opening direction pressure receiving face of the pressure reducing valve mechanism portion, the pressure of the air is added to the urge force of the pressure control spring and therefore, the pressure of compressed air at the secondary pressure side port of the pressure reducing valve mechanism portion can be increased to a predetermined value necessary for rotating the rotor of the air motor mechanism portion at high speed. That is, in an initial state of operating the trigger for operating the air tool, the pressure of the secondary pressure side port of the pressure reducing valve mechanism portion can previously be set to a low pressure, the trigger valve can initially be made to be easy to be operated.

According to the above-aspects, the pressure of compressed air is reduced to the compressed air of the low pressure specification by the pressure reducing valve mechanism portion mounted to be proximate to the air supply port of the air motor mechanism portion and therefore, a predetermined air pressure can stably be supplied to the air motor mechanism portion without being influenced by a connection mode of a length, a structure or the like of the air hose connected to the high pressure air supply source.

According to the above-aspects, the pressure reducing valve mechanism portion is arranged substantially at the center portion in the handle housing portion, the exhaust chamber for exhausting compressed air having a comparatively low pressure is constituted at the outer peripheral portion surrounding the pressure reducing valve mechanism portion and therefore, pressure withstanding performance requested for the handle housing member can be reduced. Therefore, a thickness of the handle housing member can be thinned, or material of the handle housing member can be changed from a metal material to a material of a synthetic resin of plastic or the like and therefore, light-weighted formation of the air tool can be achieved.

According to the above-aspects, a total of the handle housing excluding the space of the pressure reducing valve mechanism portion can be constituted by the exhaust chamber and therefore, the efficiency of exhausting the air motor mechanism portion can be promoted and the speed of rotating the rotor of the air motor mechanism portion can be accelerated.

The above-described aspects and objects of the invention will become further apparent from the description and the attached drawings of the specification as follows.

BRIEF DESCRIPTION OF THE DRAWINGS

These and other objects and advantages of this invention will become more fully apparent from the following detailed description taken with the accompanying drawings in which:

FIG. 4 shows a sectional view enlarging the trigger valve mechanism portion mounted to the air tool shown in FIG. 1, showing a view of a state of making the trigger ON;

DESCRIPTION OF THE EMBODIMENTS

An embodiment of the invention will be explained in details in reference to the drawings as follows. Further, in all of the drawings for explaining the embodiment, members having the same functions are attached with the same notations and a repeated explanation thereof will be omitted.

Figure 1:
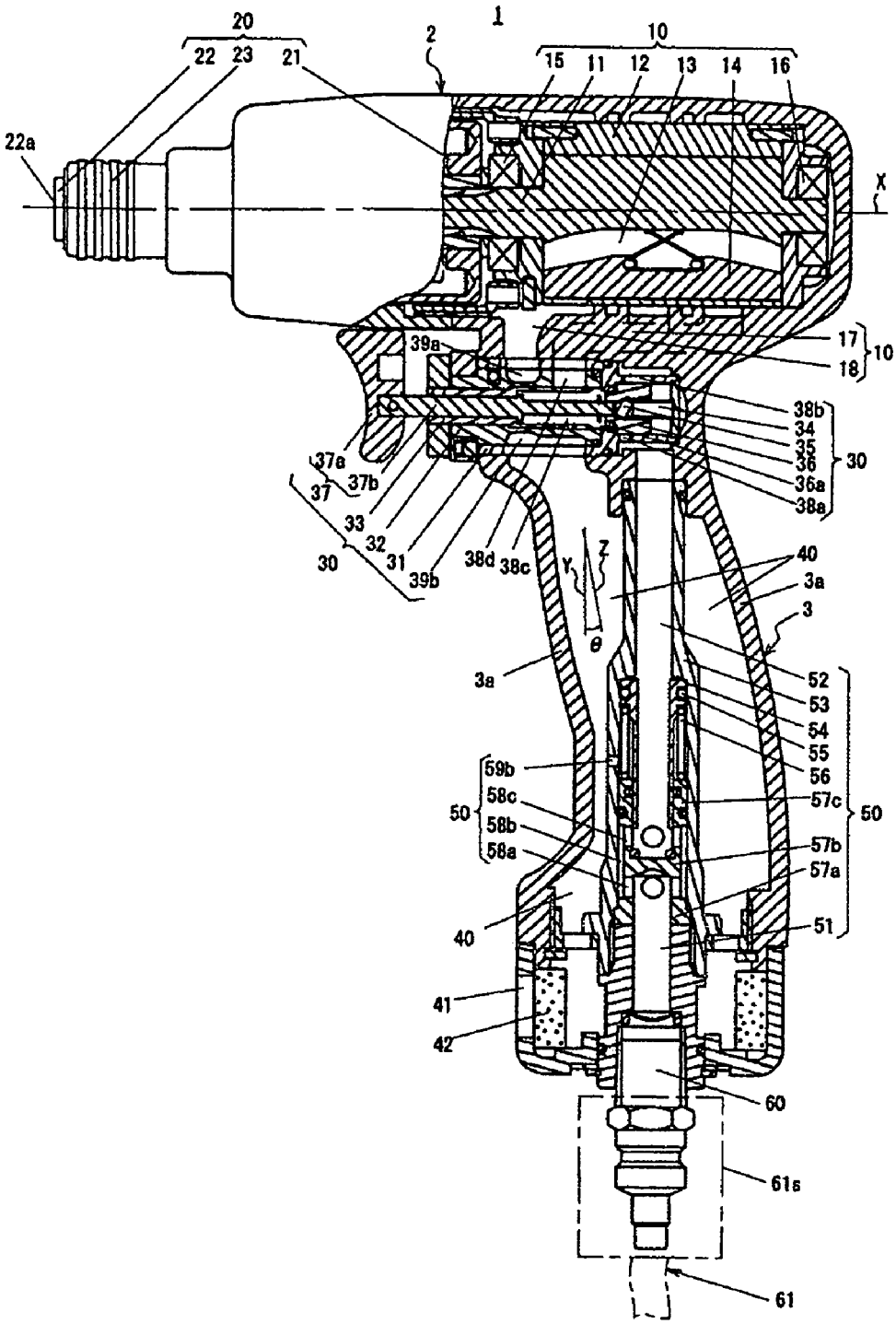
FIG. 1 is a sectional view of an air tool according to an embodiment of the invention.
Figure 2:
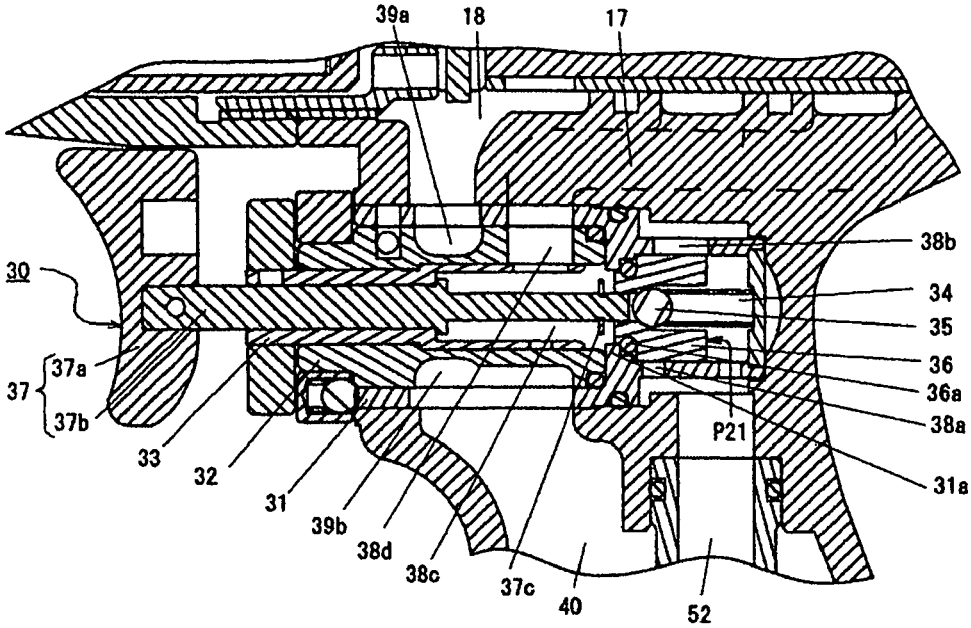
FIG. 2 shows a sectional view enlarging a trigger valve mechanism portion mounted to the air tool shown in FIG. 1, showing a view of a state of making a trigger OFF.
Figure 3:
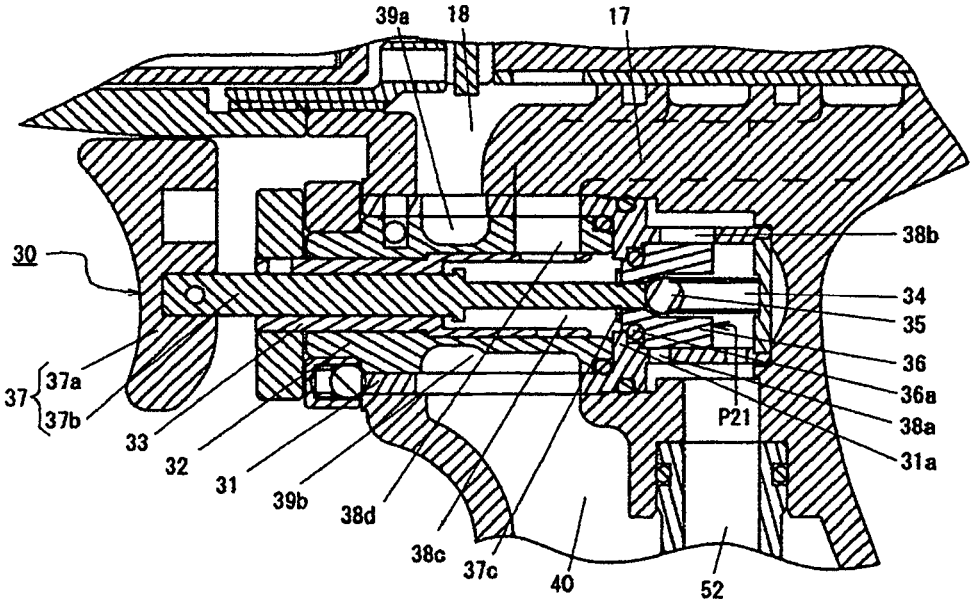
FIG. 3 shows a sectional view enlarging the trigger valve mechanism portion mounted to the air tool shown in FIG. 1, showing a view of a state of slightly pulling the trigger.
Figure 4:
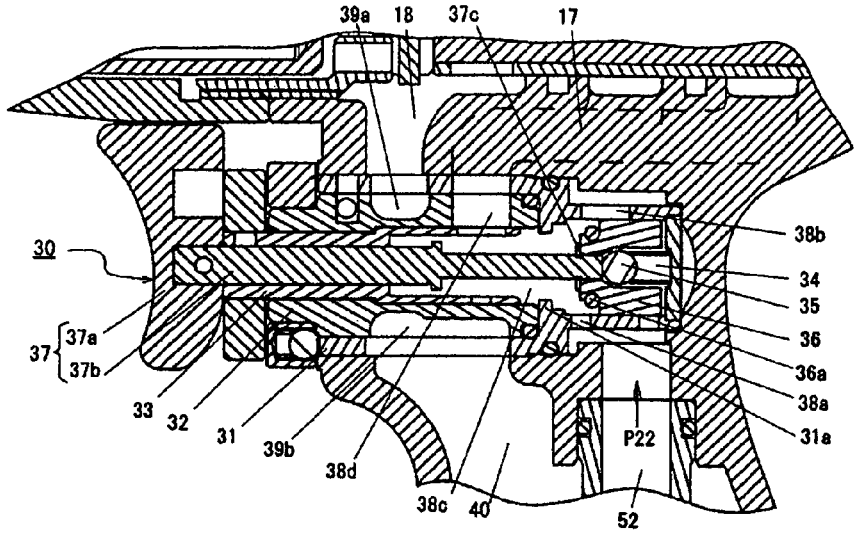
Figure 5:
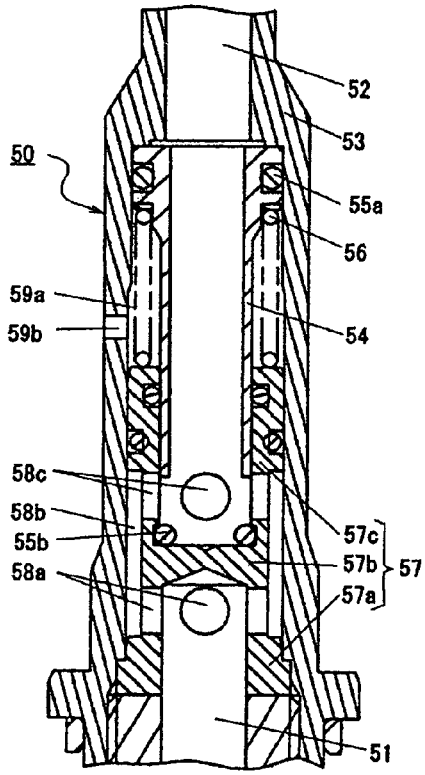
FIG. 5 shows a sectional view enlarging a pressure reducing valve mechanism portion mounted to the air tool shown in FIG. 1, showing a view of a state of making the trigger OFF when air is not connected.
Figure 7:
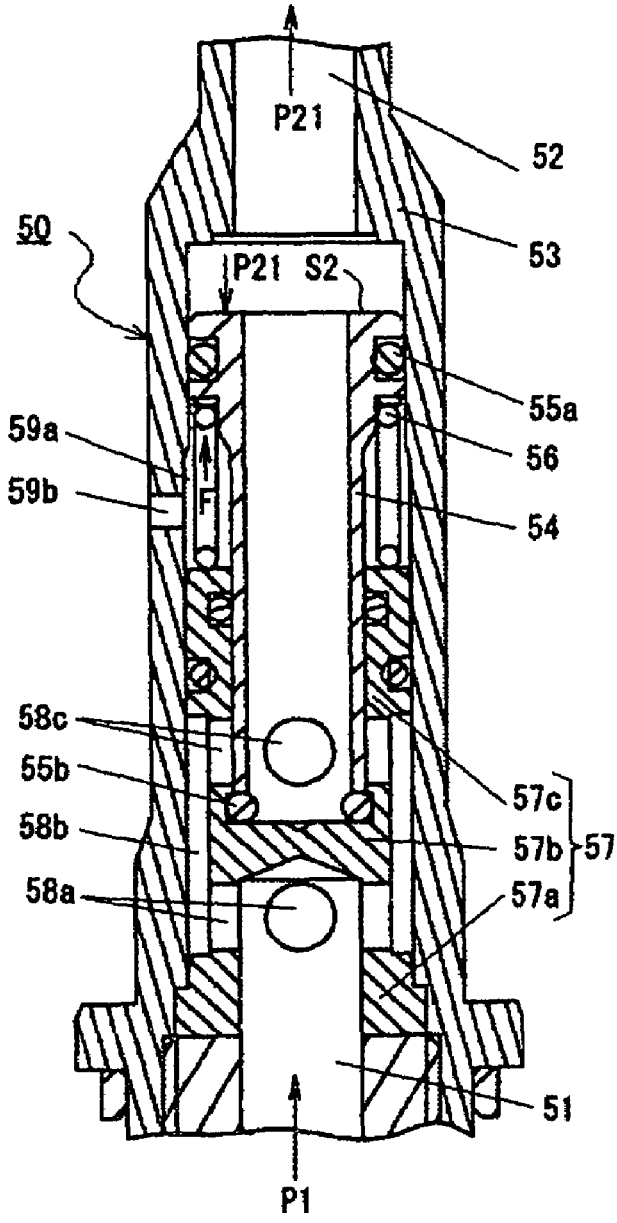
FIG. 7 shows a sectional view enlarging the pressure reducing valve mechanism portion mounted to the air tool shown in FIG. 1, showing a view of a state of making the trigger OFF after connecting air.
Figure 8:
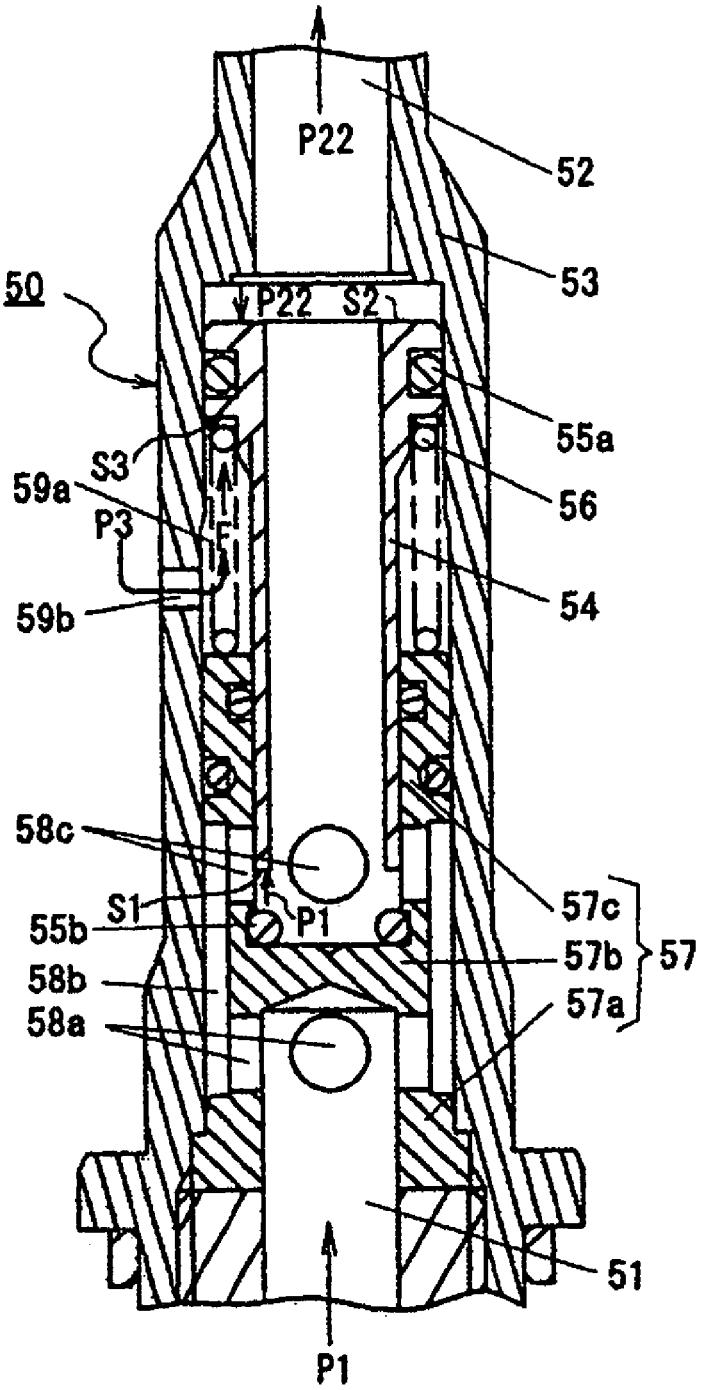
FIG. 8 shows a sectional view enlarging the pressure reducing valve mechanism portion mounted to the air tool shown in FIG. 1, showing a view of a state of making the trigger ON after connecting air.

FIG. 1 shows a sectional view of a total of an air tool according to an embodiment of applying the invention to an impact driver. FIG. 2 through FIG. 4 are sectional views enlarging a trigger valve mechanism portion mounted to the air tool shown in FIG. 1, FIG. 2 shows a state of making a trigger OFF (close), FIG. 3 shows a state of slightly pulling the trigger in an ON (open) direction from the state of FIG. 2, and FIG. 4 shows a state of maximally pulling back the trigger to be ON (open). FIG. 5 through FIG. 8 are sectional views enlarging a pressure reducing valve mechanism portion mounted to the air tool shown in FIG. 1, FIG. 5 shows a state of making the trigger OFF at an instance of being connected to a high pressure air supply source, FIG. 7 shows a state of making the trigger ON in the case of being connected to the high pressure air supply source, and FIG. 8 shows a state of making the trigger ON in the case of being connected to the high pressure air supply source.

As shown by FIG. 1, an air tool 1 according to the invention is constituted by a body housing portion 2 extended from one end portion (right end portion of the drawing) to other end portion (left end portion of the drawing) along a direction of a horizontal axis line X in a direction the same as a direction of a rotating shaft of an air motor mechanism portion 10, mentioned later, and a handle housing portion 3 hung from the body housing portion 2 along a direction of a vertical axis line Y orthogonal to the horizontal axis line X, or a direction of a skewed axis Z intersecting with the vertical axis line Y by an angle of inclination θ.

One end portion of the body housing portion 2 is mounted with the air motor mechanism portion 10 constituting a source of driving an impact driver. The air motor mechanism portion 10 is designed by a so-to-speak low pressure specification constituting a range of use by a low pressure (normal pressure) up to about 0.98 MPa, including an air motor main body including a cylinder bush 12 in a cylindrical shape fixed to inside of the housing, a rotor 11 supported by a pair of bearing portions 15 and 16, a blade 14, and a blade groove 13 inserted with the blade 14 for making compressed air flow, and the air motor memory includes an air supply port 17 for supplying compressed air to the air motor main body and an exhaust port 18 for exhausting compressed air from the air motor main body. By receiving compressed air supplied from the air supply port 17 by the blade 14, the rotor 11 is exerted with a rotational force in a predetermined direction. Compressed air which has driven the blade 14 is exhausted from the exhaust port 18.

A rotational output of the rotor 11 of the air motor mechanism portion 10 is transmitted to a power transmitting mechanism portion 20 including a rotational striking force mechanism portion (not illustrated) including a hammer frame 21 arranged at other end portion of the body housing portion 2 and an anvil 22 for receiving a rotational striking force from the rotational striking mechanism portion. The anvil 22 is attachably and detachably inserted with a driver bit (not illustrated) constituting a front end tool from a front end face 22*a* thereof along the direction of the rotating shaft X and the driver bit is fixed by a bit drawout stopping portion 23. As the front end tool, a bit for a bolt fastening hexagonal hole can also be used other than the driver bit.

As shown by FIG. 1, a trigger valve mechanism portion 30 is provided at an upper end portion of the handle housing portion. The trigger valve mechanism portion 30 is provided for communicating or cutting (closing) an air path between a secondary pressure side port 52 of a pressure reducing valve mechanism portion 50, mentioned later, and the air supply port 17 of the air motor mechanism portion 10 and controlling a flow rate of compressed air flowing from the secondary pressure side port 52 of the pressure reducing valve mechanism portion 50 to the air supply port 17. Further, air paths 39*a* and 39*b* for communicating the exhaust port 18 of the air motor mechanism portion 10 to an exhaust chamber 40, mentioned later, are provided between the trigger valve mechanism portion 30 and the handle housing portion 3. Further, FIG. 1 shows a state in which a trigger of the trigger valve mechanism portion 30 is made OFF as mentioned later and a state in which the pressure reducing valve mechanism portion 50 is not connected to a high pressure air supply source.

As shown by enlarged sectional views of FIG. 2 through FIG. 4, the trigger valve mechanism portion 30 is constituted by a first valve bush 31, a second valve bush 32, a third valve bush 33, a valve main body (opening/closing valve) 36, a trigger 37 comprising a trigger lever 37*a* and a valve rod 37*b*, an urethane ball 35 having sealing performance, and an urge spring (pressing member) 34 for pressing the valve rod 37*b* in a direction of a side of the trigger lever 37*a* by way of the urethane ball 35. The valve rod 37*b* includes a washer 37*c* for engaging with the valve member 36 when the valve rod 37*b* is moved from left to right.

As shown by FIG. 2, in a state (trigger OFF state) in which the trigger lever 37*a* is not pulled in a direction of a center axis of the valve rod 37*b* by an operator, the valve member 36 is engaged with a valve seat portion 31*a* of the first valve bush 31 along with an O ring 36*a* by a pressing force of the urge spring 34 and a pressure P21 of compressed air on the side of the secondary pressure side port 52. Further, the urethane ball 35 closes an air path (rod hole) of a center portion of the valve member 36 by receiving the pressing force of the urge spring 34. By operation of the both members, air flow paths between air flowing holes 38*a* and 38*b* and air flow out holes 38*c* and 38*d* are cut. Therefore, in the trigger OFF state shown in FIG. 2, communication of an air flow path reaching the air supply port 17 of the air motor mechanism portion 10 from the secondary pressure side port 52 of the pressure reducing valve mechanism portion 50 is cut and the air motor mechanism portion 10 is not operated to rotate.

When the operator grabs the trigger 37 to pull from left to right in the direction of the center axis of the valve rod 37*b* against a load of pulling the trigger 37 by the pressing force of the urge spring 34 and the pressure P21 (refer to FIG. 2) of compressed air of the secondary pressure side port 52, first, as shown by FIG. 3, in a state of slightly pulling the trigger 37, a seal face of the urethane ball 35 arranged at the center portion of the valve member 36 is detached from the valve member 36, an interval between the valve member 36 and the urethane ball 35 is opened, compressed air (P21) flows in from an opened clearance to rotate the rotor 11 of the air motor mechanism portion 10 by low speed.

Further, when the trigger 37 is completely pulled back to a pull back limit against the urge force of the urge spring 34 as shown by FIG. 4, the washer 37*c* provided at the valve rod 37*b* completely presses down the valve member 36 in a right direction and therefore, the valve member 36 is brought into a fully opened state of being detached from the valve seat portion 31*a*. Thereby, the valve member 36 opens the air flow paths between the air flow in holes 38*a*, 38*b* and the air flow out ports 38*c*, 38*d*, and communicates the air flow path reaching the air supply port 17 of the air motor mechanism portion 10 from the secondary pressure side port 52 of the pressure reducing valve mechanism portion 50. Therefore, compressed air having a pressure P22 (normal pressure) outputted to the secondary pressure side port 52 of the pressure reducing valve mechanism portion 50 flows into the air motor mechanism portion 10 by a large amount to rotate the rotor 11 of the air motor mechanism portion 10 at high speed.

In the case of the embodiment, in the state of slightly pulling the trigger 37 as shown by FIG. 3, as described above, the rotor 11 of the air motor mechanism portion 10 is rotated by low speed, and in the state of completely pulling the trigger 37 as shown by FIG. 4, as described above, the rotor 11 of the air motor mechanism portion 10 is rotated at high speed. That is, in the case of the embodiment, a rotational number of the air motor mechanism portion 10 is changed in two stages in correspondence with an amount of pulling the trigger valve 36. By controlling the rotational number in steps in this way, for example, in a case of carrying out a screwing operation by using the driver bit as the front end tool, at the beginning of the screwing operation, a screwed portion is positioned by low speed rotation and therefore, the air tool is operated by constant low speed rotation by pulling slightly the trigger 37, first, a front end of a screw is made to bite a fastened member to determine a position of screwing. Next, screwing can be completed by high speed rotation by increasing the amount of pulling the trigger 37. According to the invention, in order to promote the operability of the trigger 37, by a combination with a pressure reducing valve mechanism portion, mentioned later, a trigger load in starting to pull the trigger 37 is reduced. Although the operation will be described later, as a result, according to the invention, in the OFF state of the trigger 37 shown in FIG. 2, the pressure P21 of compressed air for pressing the valve member 36 is set to be smaller than the pressure P22 of compressed air for pressing the valve member 36 in the ON state of the trigger 37 shown in FIG. 4 and therefore, the operability can be promoted by transiently reducing the trigger load in starting to pull the trigger 37.

In reference to FIG. 1 again, a lower end portion of the handle housing portion 3 hung from the body housing portion 2 includes an air joint portion (plug) 60 for being connected to a high pressure air supply source, not illustrated, by way of an air hose 61. The air joint portion 60 comprises, for example, a plug for high pressure and can be connected with a socket 61*s* of the air hose 61 of a high pressure specification. That is, starting from the high pressure air supply source, shapes of the air joint portion 60 and the air hose 61 the same as those used in a high pressure air supply system of the related art can be adopted and therefore, installation cost is reduced and the way of use the air tool can be improved.

There is mounted the pressure reducing valve mechanism portion 50 in the cylindrical shape extended from the air joint portion 60 at the lower end portion of the handle housing portion 3 to the trigger valve mechanism portion 30 of the handle housing portion 3. The pressure reducing valve mechanism portion 50 is for reducing high pressure of air supplied to the air joint portion 60 to low pressure of air suitable for the air motor mechanism portion 10 of the low pressure specification. For example, according to the embodiment, a pressure of high pressure air supplied to the air joint portion 60 is 2.3 MPa, the pressure of the high pressure air is reduced by the pressure reducing valve mechanism portion 50 and compressed air of 0.8 MPa constituting the low pressure specification is supplied to the supply port 17 of the air motor mechanism portion 10 by way of the trigger valve mechanism portion 30. The pressure reducing valve mechanism portion 50 is extended from a lower end portion to an upper end portion particularly at a center portion of the handle housing portion 3.

According to the invention, a housing member 3*a* is provided by surrounding an outer peripheral portion of the pressure reducing valve mechanism portion 50 and the exhaust chamber (expanding chamber) 40 for communicating with the exhaust port 18 of the air motor mechanism portion 10 is formed by the housing member 3*a*. The exhaust chamber 40 expands compressed air exhausted from the exhaust port 18 of the air motor mechanism portion 10 to exhaust into the atmosphere from an exhaust hole 41 disposed at the lower end portion of the handle housing portion 3 by way of a noise reduction muffler 42. In operating the air motor mechanism portion 10, an exhaust pressure of the exhaust chamber 40 becomes, for example, about 0.2 MPa. According to an arrangement structure of the invention, the exhaust chamber 40 can occupy substantially a total of the handle housing portion 3 excluding the pressure reducing valve mechanism portion 50 and therefore, a wide space in correspondence with a shape of hanging the handle housing portion 3 can be ensured. As a result, an exhaust efficiency of the air motor mechanism portion 10 can be promoted, and a rotational speed of the air motor mechanism portion 10 can be accelerated. Further, the housing member 3*a* partitioning the exhaust chamber 40 may be made to be able to ensure a rupture strength against air at low pressure near to the atmospheric pressure and therefore, a thickness of the housing member 3*a* can be formed to be thin. Particularly, in a case of using a metal material as the housing member, light-weighted formation of the air tool can be achieved by thin-walled formation of the handle housing member 3*a*.

As shown by enlarged sectional views of FIG. 5 through FIG. 8, the pressure reducing valve mechanism portion 50 includes a valve housing 53 constituting a cylindrical member extended from a primary pressure side port (high pressure air side port) 51 to the secondary pressure side port (normal pressure air side port) 52, a cylindrical valve seat 57 including a primary pressure side member 57*a*, a partitioning member 57*b* and a secondary pressure side member 57*c* inwardly brought into contact with inside of a hollow space of the valve housing 53, a valve piston (opening/closing valve) 54 one end portion of which is inwardly brought into contact with inside of a hollow space of the secondary pressure side member 57*c* of the cylindrical valve seat 57 to function as an opening/closing valve and other end portion of which is slidingly moved on a hollow inner space of the cylindrical valve housing 53 in an up and down direction, and a pressure control spring 56 urging the valve piston 54 in an opening direction by a spring force F. An O ring 55*a* is inserted between the valve piston 54 and the valve housing 53. The partitioning member 57*b* includes an O ring 55*b* to be engaged with a front end portion of the valve piston 54. The pressure control spring 56 is arranged at inside of a space 59*a* hermetically closed by an inner peripheral face of the cylindrical valve housing 53 and an outer peripheral face of the valve piston 54, according to the invention, the hermetically closed space 59*a* is communicated with the exhaust chamber 40 by way of a relief hole 59*b*. The primary pressure side member 57*a* of the cylindrical valve seat 57 includes an air flow in hole 58*a*, and the secondary pressure side member 57*c* of the cylindrical valve seat 57 includes an air flow out hole 58*c*. Both of the hole 58*a* and the hole 58*c* are communicated by an air flow path 58*b*.

The valve piston 54 includes a pressure receiving face (closing direction pressure receiving face) S2 for receiving pressure P21 or P22 for compressed air operated to the valve piston (opening/closing valve) 54 in the closing direction, and a pressure receiving face (opening direction pressure receiving face) S1 for receiving pressure P1 of compressed air operated to the valve piston (opening/closing valve) 54 in the opening direction. Further, the hermetically closed space 59*a* installed with the pressure control spring 56 includes an opening direction pressure receiving face S3 at which exhaust air pressure P3 of the exhaust chamber 40 is operated to the valve piston 54 in the opening direction as shown by FIG. 8 since exhaust compressed air of the exhaust chamber 40 flows thereto from the relief hole 59*b* according to the invention. Operation of the pressure reducing valve mechanism portion 50 is as follows.

As shown by FIG. 5, in a state in which the air hose 61 (refer to FIG. 1) from the high pressure air supply source is not connected (air is not connected), the valve piston 54 is moved to an upper dead center to open the air flow out hole 58*c* by receiving the spring force F of the pressure control spring 56.

Figure 6:
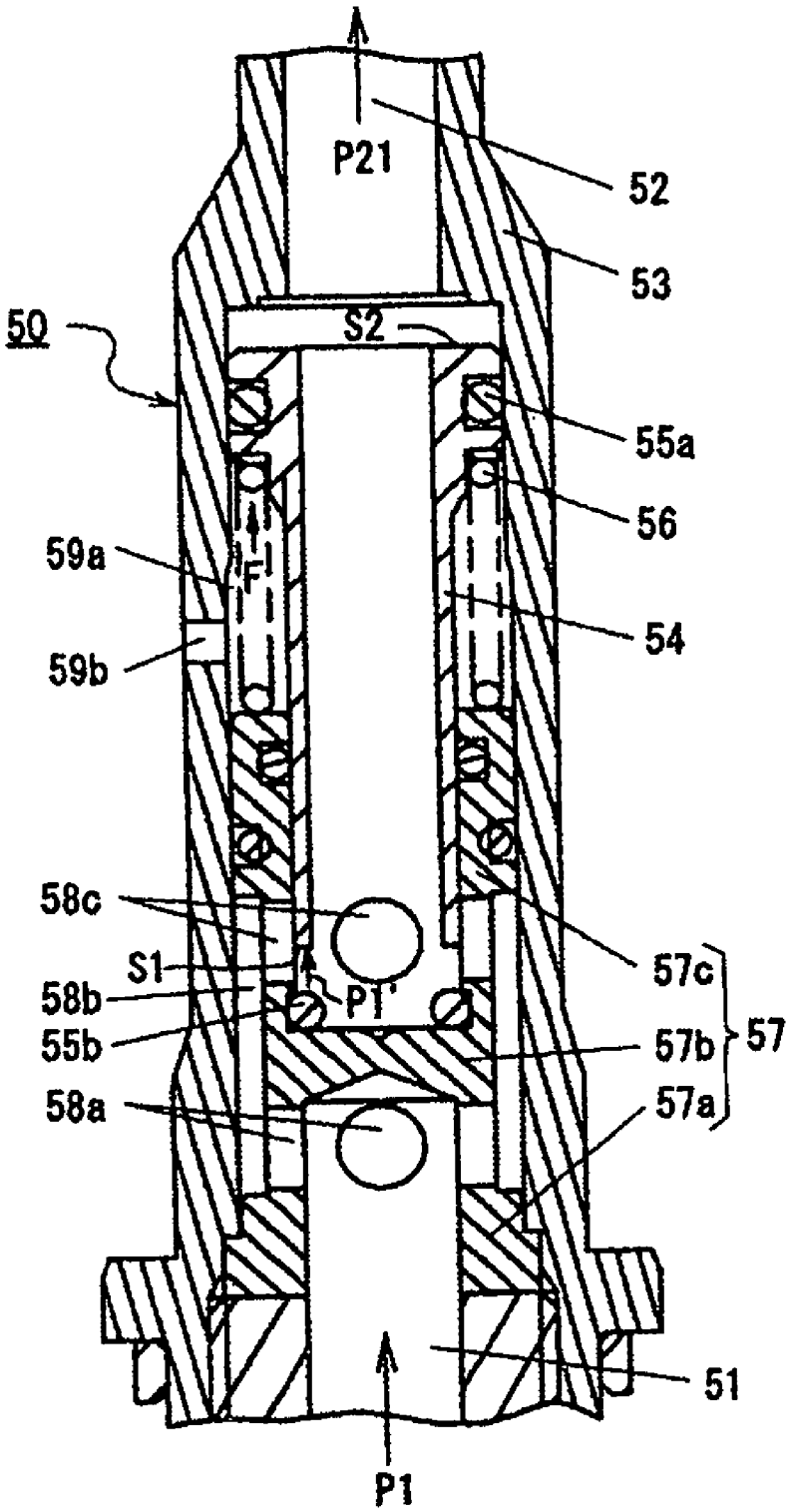
FIG. 6 shows a sectional view enlarging the pressure reducing valve mechanism portion mounted to the air tool shown in FIG. 1, showing a view of a state of making the trigger OFF at an instance of connecting air.

Next, in a transient state in which the air hose 61 from the high pressure air supply source is connected to the plug 60 (refer to FIG. 1) (instance of connecting air) as shown by FIG. 6, compressed air P1 from the high pressure air supply source is supplied to the primary pressure side port 51 of the pressure reducing valve mechanism portion 50, the pressure receiving face in the closing direction of the valve piston 54 receives compressed air P1' which has passed through the air flowing hole 58*a*, the air flow path 58*b*, and the air flow out hole 58*c* and the pressure of which is reduced against the spring force F of the pressure control spring 56, and the valve piston 54 is moved in the direction of closing the air flow out hole 58*c*.

After connecting the air source, as shown by FIG. 7, a pressure of compressed air provided at the secondary pressure side port 52 of the pressure reducing valve mechanism portion 50 becomes a pressure P22 of a low pressure specification by controlling to open/close to balance with a synthesized force=F+P1'·S1 until the valve piston 54 is brought into contact with the O ring 55*b*. Further, after the valve piston 54 is brought into contact with the O ring 55*b*, the valve piston 54 is pressed to the O ring 55*b* by a load of P21·S2−F.

As shown by FIG. 8, when an air pressure of compressed air provided at the secondary pressure side port 52 of the pressure reducing valve mechanism portion 50 is balanced with the pressure P21 and when the trigger 37 is pulled to bring about the ON state, a pressure of low pressure air provided at the secondary pressure side port 52 becomes a pressure P22 of a low pressure specification by controlling to open/close the valve piston 54 by a balance between a synthesized force of the spring force F, a force P1'·S1 received by the opening direction pressure receiving face S1, and a force P3·S3 received by the opening direction pressure receiving face S3=F+P1'·S1+P3·S3 operated to the valve piston 54 in the opening direction, and a force P22·S2 received by the closing direction pressure receiving face S2 operated to the valve piston in the closing direction. As described later, according to a characteristic of the invention, it is characterized that when the trigger 37 is brought into the ON state after connecting air, the opening/closing direction pressure receiving face S3 (in the hermetically closing chamber 59*a* of the spring 56) receives the exhaust pressure P3 of the air motor from the relief hole 59*b* communicated with the exhaust chamber 40.

Operation of the total of the air tool 1 according to the invention will be explained. As shown by FIG. 2, when the trigger 37 is brought into OFF state, the valve member 36 is closed and therefore, compressed air at pressure P21 of the secondary pressure side port 52 of the pressure reducing valve mechanism portion 50 does not flow to the air motor mechanism portion 10. Therefore, the rotor 11 of the air motor mechanism portion 10 is not rotated. In the trigger OFF state, the pressure of the exhaust chamber 40 becomes the atmospheric pressure by communicating with the atmosphere by passing through the exhaust hole 41.

On the other hand, as shown by FIG. 7, the hermetically closed chamber 59*a* of the pressure control spring 56 of the pressure reducing valve mechanism portion 50 in the OFF state of the trigger 37 is brought into the atmospheric pressure since exhaust air of the air motor mechanism portion 10 does not flow thereto from the relief hole 59*b*. In the trigger OFF state, different from the ON state of the trigger 37 explained in reference to FIG. 8, the hermetically closed chamber 59*a* does not receive or is not fed back with the pressing force P3·S3 (refer to FIG. 8) by exhaust air P3 (for example, 0.2 MPa) operated in a direction the same as that of the spring force F of the pressure control spring 56. Therefore, as shown by Fig,7, a pressure of compressed air provided at the secondary pressure side port 52 of the pressure reducing valve mechanism portion 50 becomes pressure P21 of the low pressure specification by controlling to open/close the valve piston 54 to balance with the synthetic force=F+P1'·S1 (<F+P1'S1+P3·S3) until the valve piston 54 is brought into contact with the O ring 55*b*, and after the valve piston 54 is brought into contact with the O ring 55*b*, the valve piston 54 is pressed to the O ring 55*b* by the load of P21·S2. The pressure P21 when the trigger is made OFF can be set to be lower than the pressure P22 when the trigger is made ON. For example, the pressure control spring 56 can be set such that the synthesized force of the spring force F and the exhaust air pressure P3·S3 is set such that the pressure P22 (pressure of secondary pressure side port 52) of the low pressure specification necessary for the air motor mechanism portion 10 in the ON state of the trigger 37 becomes 0.8 MPa and the pressure of the secondary pressure side port 52 pressed by the trigger valve 36 becomes 0.8 MPa−P3·S3 (for example, 0.6 MPa) in the OFF state of the trigger 37. Therefore, the pull load of the trigger 37 in the transient state (initial state) for shifting from the OFF state of the trigger 37 shown in FIG. 2 to the ON state of the trigger shown in FIG. 3 or FIG. 4 can be set to be small and therefore, the operability of the trigger 37 is improved. After operating to rotate the air motor mechanism portion 10 by increasing the amount of pulling the trigger 37 as shown by FIG. 4, the pressure reducing valve mechanism portion 50 is pressed by the exhaust air pressure P3 of the exhaust chamber 40 as shown by FIG. 8, the pressure of the secondary pressure side port 52 is increased from P21 to P22, the air motor mechanism portion 10 is rotated at high speed and at the same time, the pull load of the trigger 37 becomes equivalent to that of the air tool of the related art. According to the constitution of the invention, the pressure is reduced to that of compressed air of the low pressure specification by the pressure reducing valve mechanism portion 50 proximate to the air supply port 17 of the air motor mechanism portion 10 and mounted to inside of the handle housing and therefore, the air motor mechanism portion 10 can stably be supplied with the predetermined air pressure without being influenced by a connection mode of a length, a structure or the like of the air hose connected to the high pressure air supply source.

As is apparent from the above-described explanation, according to the invention, in the initial state (transient state) of operating the air tool by applying the trigger load to the trigger 37, pressure P21 of compressed air at the secondary pressure side port 52 of the pressure reducing valve mechanism portion 50 is set in correspondence with the urge force F of the pressure control spring 56 and therefore, the trigger load applied to the trigger 37 can be reduced at an initial stage of operating the tool. By reducing the trigger load, the operability of the trigger 37 can be promoted. In the state of applying the trigger load after operating the air tool (ON state of the trigger), air pressure P3 (for example, 0.2 MPa) exhausted from the exhaust port 18 of the air motor to the exhaust chamber 40 is received by or fed back to the opening direction pressure receiving face S3 of the pressure reducing valve mechanism portion 50. Thereby, air pressure P3 of the exhaust chamber 40 is added to urge force F of the pressure control spring 56 and therefore, pressure P22 of compressed air at the secondary pressure side port 52 of the pressure reducing valve mechanism portion 50 can be increased to a predetermined value. That is, in the initial state of operation of the trigger 37, the trigger 37 can be made to be easy to be operated in the state of reducing the pressure P1 at the secondary pressure side port 52 of the pressure reducing valve mechanism portion 50 and after operating the air tool, the pressure at the secondary pressure side port 52 of the pressure reducing valve mechanism portion 50 can be increased to the predetermined value P22.

Further, according to the invention, the pressure reducing valve mechanism portion 50 is arranged substantially at the center portion of the handle housing portion 3, the exhaust chamber 40 for exhausting compressed air at a comparatively low pressure is arranged at the outer peripheral portion of surrounding the pressure reducing valve mechanism portion 50 and therefore, pressure reducing performance requested for the handle housing member 3*a* can be reduced. The thickness of the handle housing 3*a* can be thinned, or a material of the handle housing member 3*a* can be changed from a metal material to a material of a synthetic resin of plastic or the like.

Furthermore, according to the invention, the total of the handle housing portion 3 excluding the space of the pressure reducing valve mechanism portion 50 can constitute the exhaust chamber 40 and therefore, the efficiency of exhausting the air motor mechanism portion 10 is promoted and the speed of rotating the air motor can be accelerated. Further, as described above, the pressure of compressed air of the high pressure specification is reduced to pressure of the low pressure specification by the pressure reducing valve mechanism portion 50 installed in the handle housing portion 3 and therefore, always stable air pressure can be supplied to the air motor.

Although according to the above-described embodiment, an explanation has been given of the impact driver tool, the invention is widely applicable to other air tool using the air motor.

Although the invention carried out by the inventors has been specifically explained based on the embodiment as described above, the invention is not limited to the embodiment but can variously be changed within a range not deviated from a gist thereof.

What is claimed is:

1. An air tool comprising:

an air motor mechanism portion, for generating a rotational force by the compressed air, having an air supply port and an exhaust port of compressed air;

an exhaust chamber, for discharging the compressed air exhausted from the exhaust port of the air motor mechanism portion to the atmosphere, having an exhaust hole communicating with the atmosphere at a portion of the exhaust chamber;

an air joint portion connectable to a high pressure air supply source;

a pressure reducing valve mechanism portion including a primary pressure side port connected to a side of the air joint portion, a secondary pressure side port connected to the air supply port of the air motor mechanism portion, an opening/closing valve arranged between the primary pressure side port and the secondary pressure side port for opening/closing a flow path of the compressed air flowing from the primary pressure side port to the secondary pressure side port, a pressure control spring for generating an urge force in a direction of opening the opening/closing valve, a closing direction pressure receiving face for receiving the compressed air operated in a direction of closing the opening/closing valve, and an opening direction pressure receiving face for receiving the compressed air operated to the opening/closing valve in a direction the same as the direction of the urge force of the pressure control spring; and a trigger valve mechanism portion including a valve member for opening/closing a flow path between the secondary pressure side port of the pressure reducing valve mechanism portion and the air supply port of the air motor mechanism portion, a trigger for controlling to open/close the valve member, and a pressing member for pressing in a direction reverse to a direction of operating the trigger for opening the valve member in correspondence with an amount of operating the trigger to drive the air motor mechanism portion;

wherein when the air motor mechanism portion is driven by opening the valve member by operating the trigger of the trigger valve mechanism portion, a pressure of air exhausted from the exhaust port of the air motor mechanism portion to the exhaust chamber is added to the urge force of the pressure control spring by being received by the opening direction pressure receiving face of the pressure reducing valve mechanism portion.

2. The air tool according to claim 1, further comprising:

a body housing portion extended from one end portion to other end portion thereof, and a handle housing portion hung from the body housing portion;

wherein the air motor mechanism portion is mounted to the one end portion of the body housing portion;

wherein the pressure reducing valve mechanism portion is mounted to substantially a center portion of the handle housing portion;

wherein the exhaust chamber is mounted to the handle housing portion to surround the pressure reducing valve mechanism portion contiguously to the pressure reducing valve mechanism portion; and wherein the trigger valve mechanism portion is mounted to a side of an upper end portion of the handle housing portion connected with the body housing.

3. The air tool according to claim 2, wherein the air joint portion and the exhaust hole of the exhaust chamber are mounted to a side of a lower end portion of the handle housing portion.

4. The air tool according to claim 1, wherein the pressure control spring of the pressure reducing valve mechanism portion urges the opening direction pressure receiving face at inside of a hermetically closed chamber of the pressure reducing valve mechanism portion, and the hermetically closed chamber is communicated with the exhaust chamber by way of a relief hole.

5. An air tool comprising:

a body housing portion mounted with an air motor mechanism portion having an air supply port and an exhaust port and a rotational striking mechanism portion; and a handle housing portion mounted with an air joint portion capable of being connected to a high pressure air supply source, a pressure reducing valve mechanism portion for reducing a pressure of high pressure air supplied from the air joint portion to a high pressure air side port to a pressure of low pressure air at a normal pressure air side port, a trigger valve mechanism portion including a valve member for controlling to open/close a flow path for supplying an output of reduced pressure air of the pressure reducing valve mechanism portion to the air supply port of the air motor mechanism portion, and a handle housing portion mounted with an exhaust chamber communicated with the exhaust port of the air motor mechanism portion and having an exhaust hole to the atmosphere;

wherein the pressure reducing valve mechanism portion includes an opening/closing valve for opening/closing a flow path of compressed air flowing from the high pressure air side port to the normal pressure air side port, a pressure control spring for generating an urge force in a direction of opening the opening/closing valve, a closing direction pressure receiving face for receiving compressed air operated in a closing direction of the opening/closing valve, and an opening direction pressure receiving face for receiving compressed air operated to the opening/closing valve in a direction the same as the direction of the urge force of the pressure control spring;

wherein the exhaust chamber is formed contiguously to the pressure reducing valve mechanism portion; and wherein when the air motor is driven by opening the valve member by operating the trigger valve mechanism portion, a pressure of exhausted air of the air motor mechanism portion exhausted to the exhaust chamber is added to the urge force of the pressure control spring by being received by the opening direction pressure receiving face of the pressure reducing valve mechanism portion.

6. The air tool according to claim 5, wherein the body housing portion is extended, the handle housing portion is constituted by a shape of being hung from the body housing portion, and the air plug and the exhaust hole are provided at a lower end portion of the handle housing.

7. The air tool according to claim 5, wherein the pressure control spring of the pressure reducing valve mechanism portion is engaged with the opening direction pressure receiving face at inside of a hermetically closed chamber of the pressure reducing valve mechanism portion, and the hermetically closed chamber is communicated with the exhaust chamber by way of a relief hole.

* * * * *